US009285760B2

(12) United States Patent
Araishi

(10) Patent No.: US 9,285,760 B2
(45) Date of Patent: Mar. 15, 2016

(54) IMAGE FORMING APPARATUS HAVING OPENABLE AND CLOSABLE COVER MEMBER

(75) Inventor: Kuniaki Araishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 261 days.

(21) Appl. No.: 13/447,207

(22) Filed: Apr. 14, 2012

(65) Prior Publication Data

US 2012/0263498 A1 Oct. 18, 2012

(30) Foreign Application Priority Data

Apr. 14, 2011 (JP) ..... 2011-089914

(51) Int. Cl.
*G03G 21/16* (2006.01)

(52) U.S. Cl.
CPC ..... *G03G 21/1633* (2013.01); *G03G 21/168* (2013.01); *G03G 2215/00126* (2013.01)

(58) Field of Classification Search
CPC ..... G03G 21/1623; G03G 21/1628; G03G 21/1633
USPC ..... 399/121, 124, 125
See application file for complete search history.

(56) References Cited

U.S. PATENT DOCUMENTS

| | | | | |
|---|---|---|---|---|
| 3,088,686 | A * | 5/1963 | Curry | 242/596.1 |
| 5,041,872 | A * | 8/1991 | Nukaya et al. | 399/107 |
| 7,616,916 | B2 * | 11/2009 | Hozono et al. | 399/121 |
| 2007/0201921 | A1 * | 8/2007 | Asada et al. | 399/393 |
| 2007/0212108 | A1 | 9/2007 | Hozono et al. | |
| 2010/0278557 | A1 * | 11/2010 | Somemiya et al. | 399/124 |

* cited by examiner

*Primary Examiner* — Ryan Walsh
*Assistant Examiner* — Philip Marcus T Fadul
(74) *Attorney, Agent, or Firm* — NDQ&M Watchstone LLP

(57) ABSTRACT

An image forming apparatus includes a bearing support portion that is provided in a cover member and supports a bearing member and a spring member and a bearing guide portion that is provided in an apparatus main body and has a guide groove that extends in a first direction and in which an outer peripheral portion of the bearing member is fitted when the cover member is in a close position. The bearing support portion has an opening portion extending in the first and second directions and a contact portion, and the bearing member has a convex portion that is formed on one side relative to an outer peripheral surface and is movable within the opening portion in the first and second directions and a regulation lug that is formed on the other side relative to the outer peripheral surface and, when the cover member is in an open position, can come in contact with the contact portion under a biasing force of the spring member.

8 Claims, 11 Drawing Sheets

IMAGE FORMING APPARATUS HAVING OPENABLE AND CLOSABLE COVER MEMBER

This application is based on Japanese Patent Application No. 2011-089914 filed on Apr. 14, 2011, the contents of which are hereby incorporated by reference.

BACKGROUND

1. Field

The present disclosure relates to an image forming apparatus such as a copy machine, a printer, a facsimile, a multifunctional peripheral having functions of these apparatuses, or the like.

2. Description of Related Art

In a conventional image forming apparatus such as a copy machine, a printer, or the like, for the purpose of achieving size reduction of the apparatus, a paper conveying path is often provided in the vertical direction in the vicinity of a side surface of the apparatus. In the conveying path provided in the vertical direction, a transfer roller pair for transferring an image onto a paper sheet is disposed, and one of rollers of this transfer roller pair, a conveying guide surface, and so on are provided in a unitized form in a cover member. When an operation such as clearing of a jam or maintenance is performed, in a case where the cover member is structured to be opened and closed from the side surface of a main body of the apparatus, the conveying path is exposed in a wide area, and thus the operation such as clearing of a jam or maintenance can be facilitated.

There has been disclosed a related art in which a cover member is opened and closed from a side surface of an apparatus main body. An image forming apparatus according to this related art includes, as a transfer roller pair, a transfer roller and a photosensitive drum that is in press-contact with the transfer roller. The transfer roller is provided in a cover member that is openable and closable with respect to the apparatus main body. Furthermore, the transfer roller includes a bearing member that rotatably supports a rotary shaft, a spring member that presses the bearing member to the side of the photosensitive drum, and a bearing holder. The bearing holder houses the bearing member by covering it from outside and supports the bearing member so that it is movable within a space in which it is housed in an open/close direction of the cover member and in a direction perpendicular to the open/close direction. The photosensitive drum, on the other hand, is provided in the apparatus main body. In the apparatus main body, in addition to the photosensitive drum, a bearing guide portion is provided. The bearing guide portion extends in the direction of a rotation center of the photosensitive drum and has a guide groove in which the rotary shaft of the transfer roller is to be fitted. When the cover member is closed with respect to the apparatus main body, the bearing member of the transfer roller moves within the housing space in the bearing holder, so that the rotary shaft of the transfer roller comes to be properly opposed to the guide groove in the apparatus main body and is fitted in the guide groove. As a result of this, the transfer roller forms a nip portion with respect to the photosensitive drum, where a recording medium can be conveyed in a state of being nipped between the transfer roller and the photosensitive drum.

The image forming apparatus of the above-described related art, however, has presented a problem that the bearing member and the bearing holder that movably supports the bearing member are constituent components having complicated configurations, respectively. Particularly, the configuration of the bearing holder is so complicated that difficulty is involved in integrating the bearing holder with the cover member, leading to an increase in the number of components used and thus resulting in a cost increase.

SUMMARY

It is an object of the present disclosure to provide an image forming apparatus that, using a simple configuration, supports a pair of rotary bodies in an openable and closable cover member and in an apparatus main body, respectively, and in which the pair of rotary bodies reliably come in press-contact with each other when the openable and closable cover member is in a closed state.

An image forming apparatus according to one aspect of the present disclosure includes a cover member, a first rotary body, a second rotary body, a rotary shaft, a bearing member, a spring member, a bearing support portion, and a bearing guide portion. The cover member is supported so as to be circularly movable between an open position and a close position with respect to an apparatus main body. The first rotary body is rotatably supported on the side of the cover member. The second rotary body is rotatably supported on the side of the apparatus main body and, when the cover member is in the close position, comes in press-contact with the first rotary body so that a recording medium is conveyed between the second rotary body and the first rotary body. The bearing member rotatably supports the rotary shaft provided at each of both end portions of the first rotary body. The spring member biases the bearing member so that the first rotary body is pressed against the second rotary body. The bearing support portion is provided in the cover member and supports, in addition to the spring member, the bearing member so that the bearing member is movable in a first direction connecting between rotation centers of the first and second rotary bodies and a second direction perpendicular to the first direction and to an axial direction of the rotary shaft. The bearing guide portion is provided in the apparatus main body and has a guide groove that extends in the first direction and in which an outer peripheral portion of the bearing member is fitted when the cover member is in the close position. Moreover, the bearing support portion has an opening portion that extends in the first and second directions and a contact portion that is formed on the opposite side to the opening portion relative to the rotary shaft. The bearing member has a cylindrical bearing portion that rotatably supports the rotary shaft, a convex portion that is formed so as to protrude from an outer peripheral surface of the bearing portion and is movable within the opening portion in the first and second directions, and a regulation lug that is formed at a position deviating from the position of the convex portion in a radial direction of the bearing portion and, when the cover member is in the open position, can come in contact with the contact portion under a biasing force of the spring member. When the cover member is closed with respect to the apparatus main body, the convex portion moves within the opening portion, and the outer peripheral portion of the bearing member is thereby guided into the guide groove and fitted therein.

Still other objects of the present disclosure and specific advantages provided by the present disclosure will be made further apparent from the following description of an embodiment.

BRIEF DESCRIPTION OF THE DRAWINGS

FIG. 6 is a perspective view showing the bearing member according to the embodiment of the present disclosure.

DETAILED DESCRIPTION OF PREFERRED EMBODIMENT

The following describes an embodiment of the present disclosure with reference to the appended drawings without limiting the present disclosure thereto. Furthermore, an intended use of the disclosure and terms and so on included in the following description are not to be construed as limiting.

Figure 1:
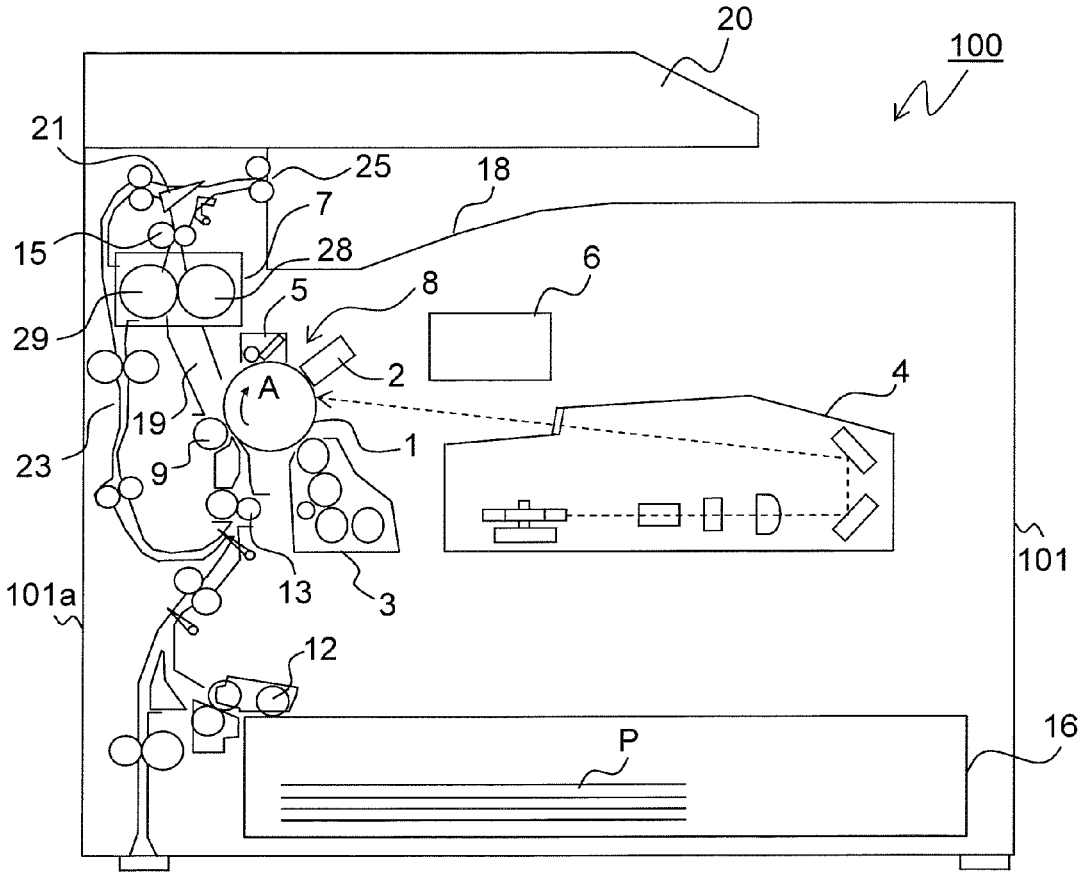
FIG. 1 is a sectional view schematically showing an entire configuration of an image forming apparatus according to an embodiment of the present disclosure.

FIG. 1 is a sectional view showing an entire configuration of an in-body paper discharge type image forming apparatus. In a lower portion of an image forming apparatus 100, a cassette type paper feeding part 16 is provided. In the paper feeding part 16, paper sheets P that are recording media before being subjected to printing are housed in a stacked manner. The paper sheets P housed in the paper feeding part 16 are fed out one by one by a pick-up roller 12, and the paper sheet P thus fed out is conveyed to a paper conveying path 19.

The paper conveying path 19 extends upward from the paper feeding part 16 along a side surface 101*a* of the image forming apparatus 100 to reach an in-body paper discharge part 18. Along this paper conveying path 19, in order from the upstream side, a resist roller pair 13, an image forming part 8, a fixing part 7, and an exit roller pair 25 are disposed. The paper sheet P fed out from the paper feeding part 16 is conveyed to the resist roller pair 13. The resist roller pair 13 conveys the paper sheet P toward the image forming part 8 in synchronization with timing at which a toner image is transferred onto the paper sheet P.

In an upper portion of the image forming apparatus 100, an original document reading part 20 is provided. The original document reading part 20 is composed of a scanning optical system that performs, by use of a mirror, scanning with reflected light from an original document that is illuminated, a condenser lens that condenses reflected light from the original document so as to form an image on an optoelectronic transducer, and the optoelectronic transducer that converts image light thus formed into an electrical signal (none of these are shown in the figure). The original document reading part 20 thus reads an original document image and converts the read original document image into image data.

In a substantially central portion of the image forming apparatus 100, the image forming part 8 is provided. The image forming part 8 includes a photosensitive drum 1 that is an image bearing member and further includes, on the periphery of the photosensitive drum 1 as a second rotary body, in order along a rotation direction of the photosensitive drum 1 (A direction in the figure), a charging part 2, an exposure unit 4, a development part 3, a transfer roller 9 as a first rotary body, and a cleaning part 5. The development part 3 is supplied with toner from a toner container 6. The cleaning part 5 has a cleaning member such as a blade, a brush, an abrasive roller, or the like and scrapes off and collects excess toner remaining on a surface of the photosensitive drum 1.

With the surface of the photosensitive drum 1 charged evenly at a predetermined polarity and a predetermined potential by the charging part 2, the exposure unit 4 forms, based on image data of an original document read by the original document reading part 20, an electrostatic latent image of an original document image on the photosensitive drum 1.

The development part 3 supplies charged toner to the surface of the photosensitive drum 1 so as to develop an electrostatic latent image on the photosensitive drum 1 into a toner image. The toner image is transferred onto the paper sheet P by the transfer roller 9. After the toner image has been transferred onto the paper sheet P, excess toner remaining on the surface of the photosensitive drum 1 is cleaned and collected by the cleaning part 5, and residual electric charge on the surface of the photosensitive drum 1 is removed by an unshown static eliminator.

The fixing part 7 has a fixing roller 28 that is heated by a heat source and a pressing roller 29 that is in press-contact with the fixing roller 28 and, by use of the fixing roller 28 and the pressing roller 29, applies pressure and heat to the paper sheet P onto which a toner image has been transferred so that the toner image on the paper sheet P is fixed by fusing. The paper sheet P on which the toner image has thus been fixed is conveyed upward by a conveying roller pair 15 and is then discharged onto the in-body paper discharge part 18 by the exit roller pair 25.

At a point on the paper conveying path 19 between the fixing part 7 and the exit roller pair 25, a reversing conveying path 23 diverges from the paper conveying path 29. The reversing conveying path 23 is used in a case where, after a toner image has been fixed on one side of the paper sheet P, a toner image is formed also on the other side of the paper sheet P as necessary. The reversing conveying path 23 extends from above the fixing part 7 downward between the paper conveying path 19 and the side surface 101*a* of the image forming apparatus 100 and merges into the paper conveying path 19 in the vicinity of the resist roller pair 13.

In a case where double-side printing is performed, at a stage when the paper sheet P with a toner image fixed on one side thereof is on its way to be discharged onto the in-body paper discharge part 18, a diverging guide 21 provided at a diverging point between the paper conveying path 19 and the reversing conveying path 23 is switched to the side of the reversing conveying path 23, and the rotation direction of the exit roller pair 25 is reversed. The paper sheet P is thereby conveyed in a switchback manner to the reversing conveying path 23 and is conveyed therefrom again to the resist roller pair 13 provided in the paper conveying path 19. Then, a toner image is transferred also onto the other side of the paper sheet P by the image forming part 8, after which the paper sheet P is subjected to fixing by the fixing part 7 and is then discharged onto the in-body paper discharge part 18.

Figure 2:
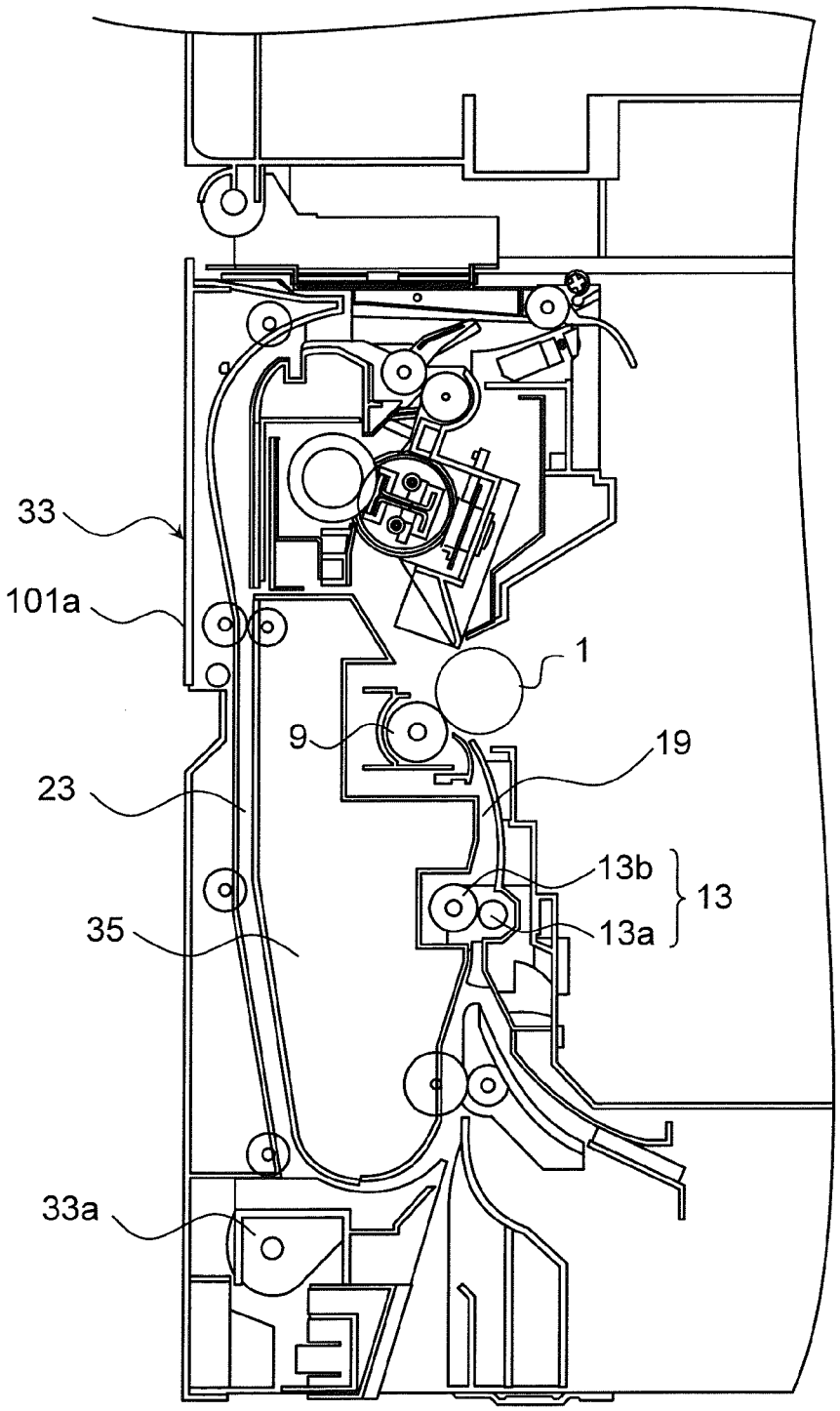
FIG. 2 is a sectional view showing a paper conveying path in the image forming apparatus according to the embodiment of the present disclosure.
Figure 3:
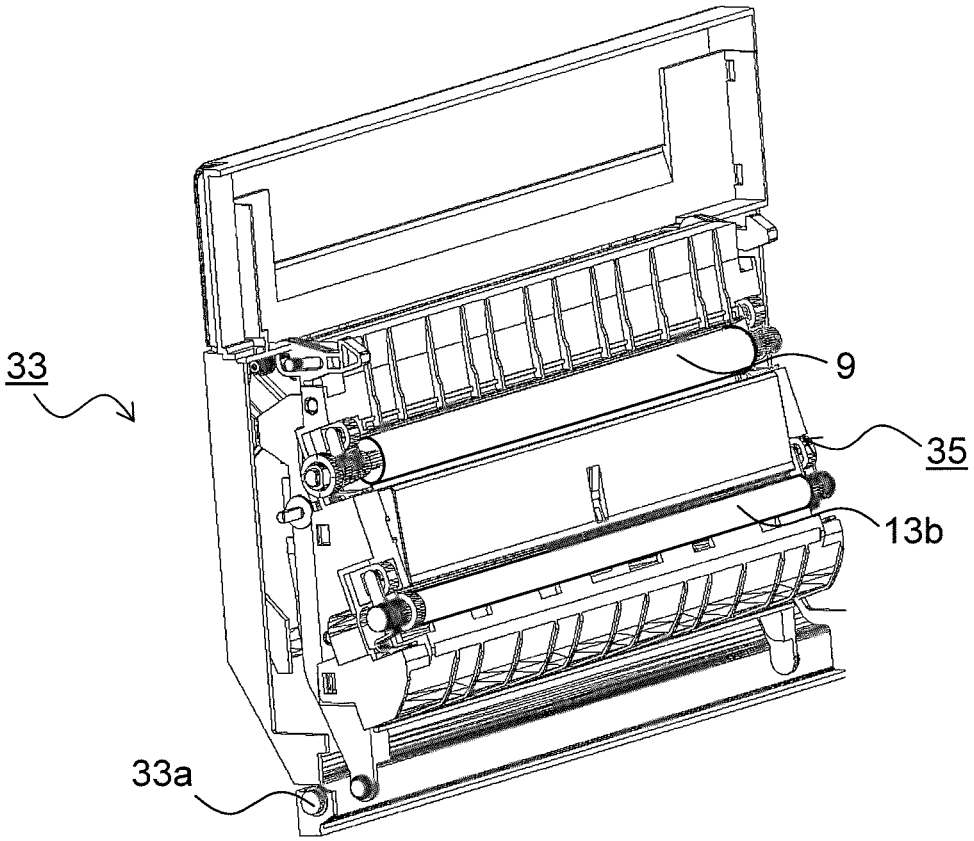
FIG. 3 is a perspective view showing a cover member of the image forming apparatus according to the embodiment of the present disclosure.

FIG. 2 is a sectional view of the paper conveying path 19 in the image forming apparatus 100, and FIG. 3 is a perspective view of a cover member 33 as seen from the inside of the apparatus (right side in FIG. 2).

The cover member 33 constitutes the side surface 101*a* of the image forming apparatus 100 and includes a conveyor unit 35 on the opposite side to the side surface 101*a*.

The conveyor unit 35 constitutes part of the paper conveying path 19 and part of the reversing conveying path 23. The reversing conveying path 23 extends between the side surface 101*a* of the image forming apparatus 100 and the paper conveying path 19 in the up-and-down direction along the side surface 101*a* and is curved on each of the upper and lower sides into a substantially C-shape to merge into the paper conveying path 19. The conveyor unit 35 includes, in order from the upstream side in a paper conveying direction (lower side in each of FIGS. 2 and 3), a roller 13*b* that is one of rollers constituting the resist roller pair 13 and the transfer roller 9 as the first rotary body. The transfer roller 9 is pressed against the photosensitive drum 1 as the second rotary body provided on the side of an apparatus main body 101.

The cover member 33 is circularly movably supported at a fulcrum 33*a* provided in the vicinity of a lower portion of the side surface 101*a*, and a circular movement operation of the cover member 33 opens and closes the apparatus so that an inner portion of the apparatus can be open to the air when the apparatus is opened. By a circular movement operation of the cover member 33 in an open direction, the conveyor unit 35 is separated from the apparatus main body 101 and exposed. On the other hand, by a circular movement operation of the cover member 33 in a close direction, the transfer roller 9 is pressed against the photosensitive drum 1.

Figure 4:
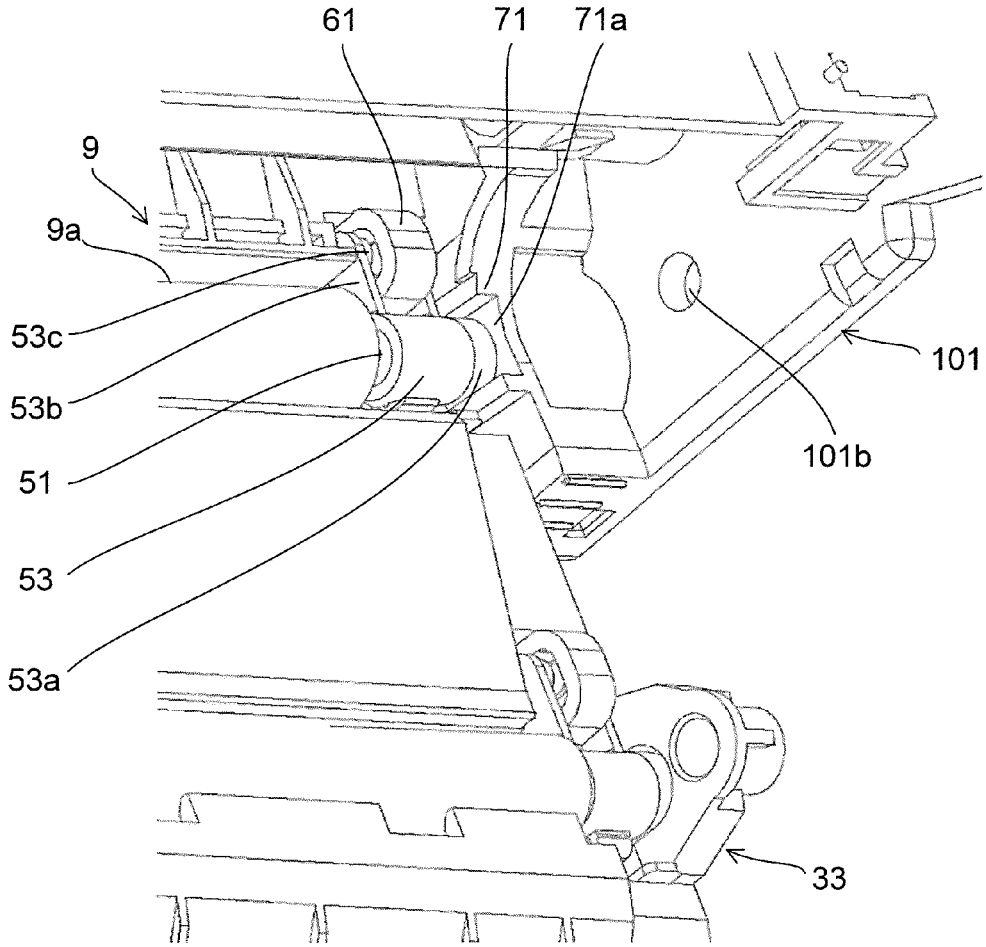
FIG. 4 is a perspective view showing a bearing member of a transfer roller provided in the cover member and a bearing guide portion in an apparatus main body according to the embodiment of the present disclosure.

FIG. 4 is a perspective view of the periphery of a main portion of the transfer roller 9 in a state where the cover member 33 is closed as seen from the inside of the apparatus. In FIG. 4, however, the photosensitive drum 1 is omitted for the sake of explaining a configuration of the transfer roller 9. Furthermore, in the following, a configuration of the transfer roller 9 on one end side in an axial direction thereof is described, and as for a configuration of the transfer roller 9 on the other end side, since it is similar to the configuration thereof on the one end side, a description thereof is omitted.

The transfer roller 9 has a roller portion 9*a* that comes in contact with the photosensitive drum 1 (see FIG. 2), a rotary shaft 51 provided at an end portion of the roller portion 9*a* in an axial direction thereof, and a bearing member 53 that rotatably supports the rotary shaft 51. The photosensitive drum 1 is rotatably supported by a drum bearing hole 101*b* formed through the apparatus main body 101.

The bearing member 53 has a pair of arm portions 53*b* extending from an outer peripheral surface thereof, a convex portion 53*c* formed on each of the arm portions 53*b*, and an outer peripheral portion 53*a* formed on the outer peripheral surface at an end portion of the bearing member 53 in an axial direction thereof. The convex portion 53*c* is movably supported by a bearing support portion 61 provided in the conveyor unit 35. Furthermore, the outer peripheral portion 53*a* is configured so as to be able to be fitted in a guide groove 71*a* formed in a bearing guide portion 71 in the apparatus main body 101. In a state where the outer peripheral portion 53*a* of the bearing member 53 is fitted in the guide groove 71*a*, the roller portion 9*a* of the transfer roller 9 is in contact with the photosensitive drum 1.

Figure 5:
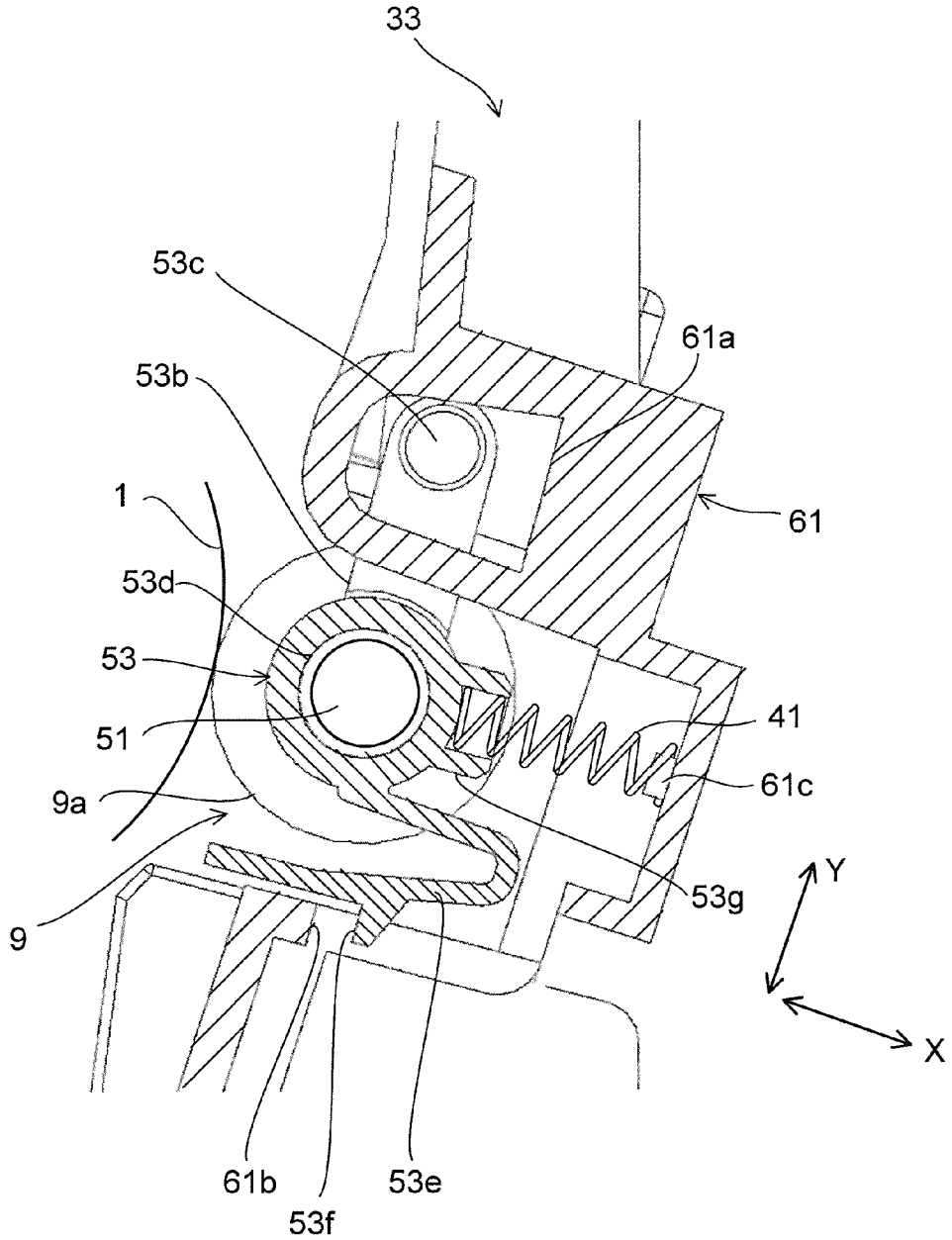
FIG. 5 is a sectional view showing the bearing member and a bearing support portion according to the embodiment of the present disclosure.
Figure 6A:
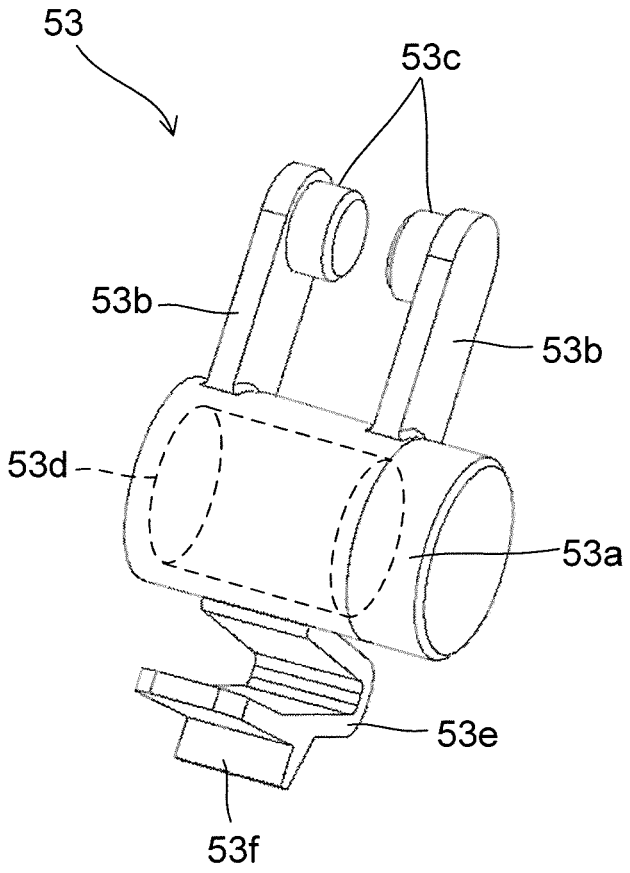
FIG. 6A shows a first type of the bearing member.
Figure 6B:
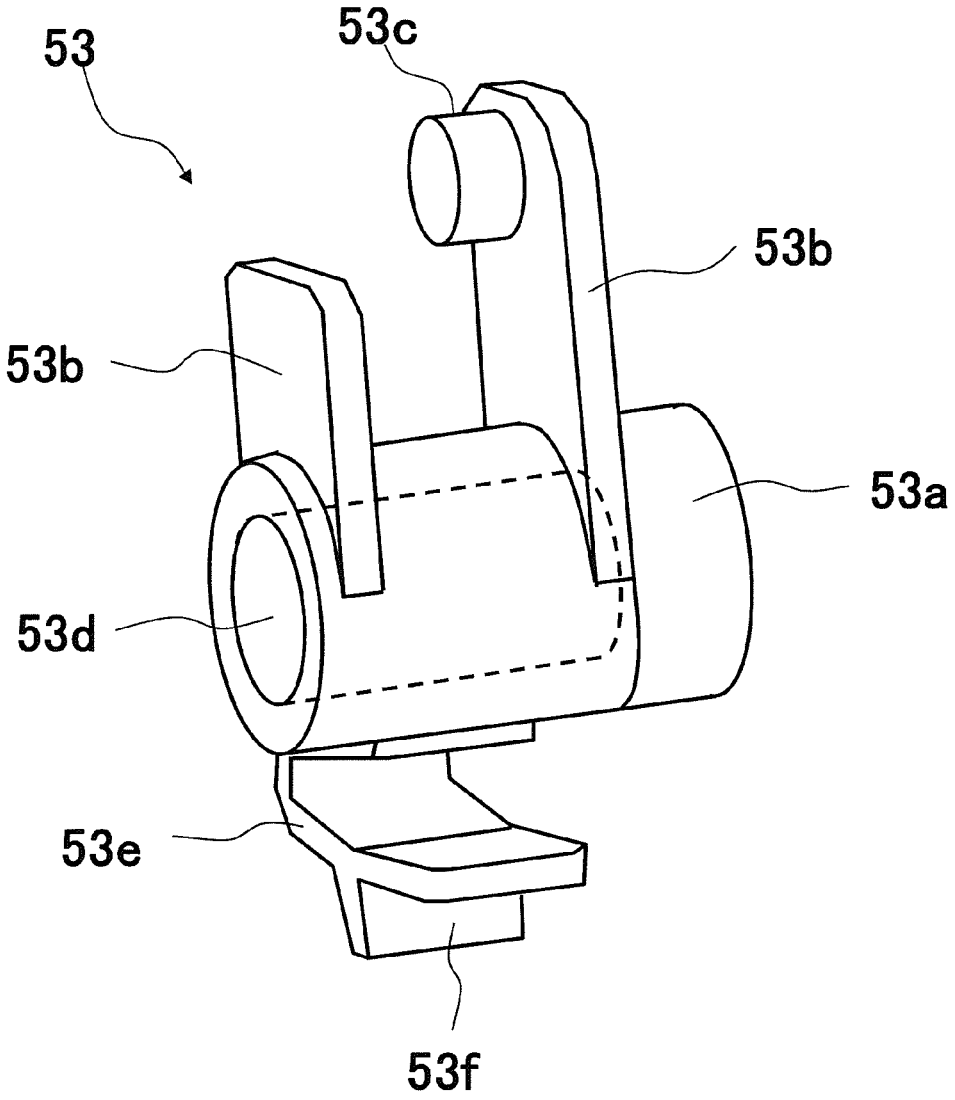
FIG. 6B shows a second type of the bearing member.

Referring to FIGS. 5 and 6, the following describes detailed configurations of the bearing member 53 and the bearing support portion 61. FIG. 5 is a sectional view showing the bearing member 53 and the bearing support portion 61 in a state where the transfer roller 9 is in press-contact with the photosensitive drum 1, and FIG. 6 is a perspective view showing the bearing member 53. FIG. 6A shows a first type of the bearing member 53, and FIG. 6B shows a second type of the bearing member 53.

The bearing support portion 61 has, as shown in FIG. 5, an opening portion 61*a*, a contact portion 61*b*, and a spring bearing portion 61*c* and is made of resin.

The opening portion 61*a* is a through hole formed in a substantial trapezoidal shape in outline, and the convex portion 53*c* of the bearing member 53 is movably inserted thereinto. When the convex portion 53*c* moves within the opening portion 61*a*, the bearing member 53 can accordingly move in the same direction as a direction in which the convex portion 53 moves. The bearing member 53 can also move circularly relative to the convex portion 53*c* as a fulcrum. That is, in a plane including a direction X (first direction) connecting between a rotation center of the transfer roller 9 and a rotation center of the photosensitive drum 1 and a direction Y (second direction) perpendicular to this first direction and to an axial direction of the rotary shaft 51 of the transfer roller 9, the bearing member 53 can move within an area defined by the opening portion 61*a* and can move circularly relative to the convex portion 53*c* as the fulcrum.

The spring bearing portion 61*c* is formed so as to protrude in a columnar shape from a base of the bearing support portion 61 and, together with a spring bearing portion 53*g* formed at the bearing member 53, holds a spring member 41 so that it is expandable. The spring member 41 is a compression coil spring and biases the bearing member 53 to the side of the photosensitive drum 1. Under this biasing force of the spring member 41, the roller portion 9*a* of the transfer roller 9 is in press-contact with the photosensitive drum 1.

The contact portion 61*b* is disposed on the opposite side to the opening portion 61*a* relative to the rotary shaft 51 of the transfer roller 9 so as to be opposed to a regulation lug 53*f* formed at the bearing member 53. Furthermore, the contact portion 61*b* is formed to have a flat surface in the second direction (Y direction in FIG. 5) so as to allow the regulation lug 53*f* of the bearing member 53 to come in contact therewith. When the transfer roller 9 is in press-contact with the photosensitive drum 1 (a state shown in FIG. 5), the regulation lug 53*f* is away from the contact portion 61*b*, while when the cover member 33 is opened with respect to the apparatus main body 101, under a biasing force of the spring member 41, the regulation lug 53*f* comes in contact with the contact portion 61*b*.

As described above, the opening portion 61*a*, the contact portion 61*b*, and the spring bearing portion 61*c* are configured in relatively simple forms, and thus the bearing support portion 61 can be molded integrally with a resin member used in the conveyor unit 35.

On the other hand, the bearing member 53 has, in addition to the regulation lug 53*f*, the arm portions 53*b*, the convex portion 53*c*, and the spring bearing portion 53*g*, which are described above, a bearing portion 53*d* that rotatably supports the rotary shaft 51 of the transfer roller 9, a hook portion 53*e* that connects the regulation lug 53*f* with the outer peripheral surface of the bearing member 53, and the outer peripheral portion 53*a* (see FIG. 6) and is made of resin.

As the first type of the bearing member 53 shown in FIG. 6A, a pair of convex portions 53*c* are provided so as to be opposed at a predetermined space from each other. The convex portions 53*c* are inserted from both sides into the opening portion 61*a* (see FIG. 5) of the bearing support portion 61 and thus are movably held in the opening portion 61*a*.

By this configuration, the convex portions 53*c* of the bearing member 53 can be easily mounted in the opening portion 61*a* of the bearing support portion 61. That is, the pair of arm portions 53*b* are formed so as to protrude from the outer periphery of the bearing member 53 and thus are elastically deformable due to the elasticity of a resin material. The convex portion 53*c* is provided at an upper end portion of each of the arm portions 53*b*, so that when the arm portions 53*b* are elastically deformed, the pair of convex portions 53*c* can move in such a direction as to be away from each other. Based on this, the pair of convex portions 53*c* are made to move so that a distance between them becomes larger than the thickness of the bearing support portion 61, and when the pair of convex portions 53*c* come to be opposed to the opening portion 61*a* of the bearing support portion 61, the arm portions 53*b* in an elastically deformed state are restored to their original shapes. Thus, the convex portion 53 is inserted into the opening portion 61*a* of the bearing support portion 61. As the second type of the bearing member 53 shown in FIG. 6B, a convex portion 53*c* is provided at an upper end portion of one of the arm portions 53*b*, so that when the arm portions 53*b* are elastically deformed, the convex portion 53*c* can move in such a direction as to be away from the other arm. Based on this, the convex portion 53*c* is made to move so that a distance between the convex portion 53*c* and the opposite arm portion 53*b* becomes larger than the thickness of the bearing support portion 61, and when the convex portion 53*c* comes to be opposed to the opening portion 61*a* of the bearing support portion 61, one of the arm portions 53*b* in an elastically deformed state is restored to its original shape. Thus, the convex portion 53*c* is inserted into the opening portion 61*a* of the bearing support portion 61. The both arm portions 53*b* sandwich the bearing support portion 61. The first type of the bearing member 53 is able to be held on the bearing support portion 61 tightly, and the second type of the bearing member 53 is able to be mounted on the bearing support portion 61 more easily.

The regulation lug 53*f* is disposed on the opposite side to the convex portion 53*c* relative to the bearing portion 53*d* and is connected with the outer peripheral surface of the bearing member 53 at the hook portion 53*e* formed in a substantially U-shape in cross section. Due to the elasticity of the resin material and elasticity resulting from the U-shape thereof, the hook portion 53*e* is elastically deformable in the second direction Y (see FIG. 5). The hook portion 53*e* is not limited in shape to the substantially U-shape in cross section and may be in any of various shapes such as a wave shape in cross section or the like as long as it is elastically deformable in the second direction Y.

By this configuration, the regulation lug 53*f* can be easily mounted so as to be opposed to the contact portion 61*b* (see FIG. 5) of the bearing support portion 61. That is, the convex portion 53*c* of the bearing member 53 is inserted into the opening portion 61*a* of the bearing support portion 61, and then, in a state where the hook portion 53*e* is elastically deformed toward the side of the outer peripheral surface of the bearing member 53, the regulation lug 53*f* is forced over and past the contact portion 61*b* of the bearing support portion 61, after which the hook portion 53*e* in the elastically deformed state is restored to its original shape. Thus, the regulation lug 53*f* can be easily mounted at a position where it is opposed to the contact portion 61*b* of the bearing support portion 61.

The bearing portion 53*d* is a hole into which the rotary shaft 51 (see FIG. 5) of the transfer roller 9 is rotatably fitted. The outer peripheral portion 53*a*, which is formed on the outer peripheral surface on a side closer to an end portion in the axial direction than the pair of arm portions 53*b*, is guided into the guide groove 71*a* (see FIG. 4) formed in the bearing guide portion 71 in the apparatus main body 101 and is further fitted in a predetermined position therein.

When the cover member 33 is moved circularly to the right in FIG. 5 from the state shown in FIG. 5 where the transfer roller 9 is in press-contact with the photosensitive drum 1 (a close position of the cover member 33), the cover member 33 is moved to an open position. Together with the cover member 33, the bearing member 53 moves circularly and is brought to a state shown in FIG. 7.

Figure 7:
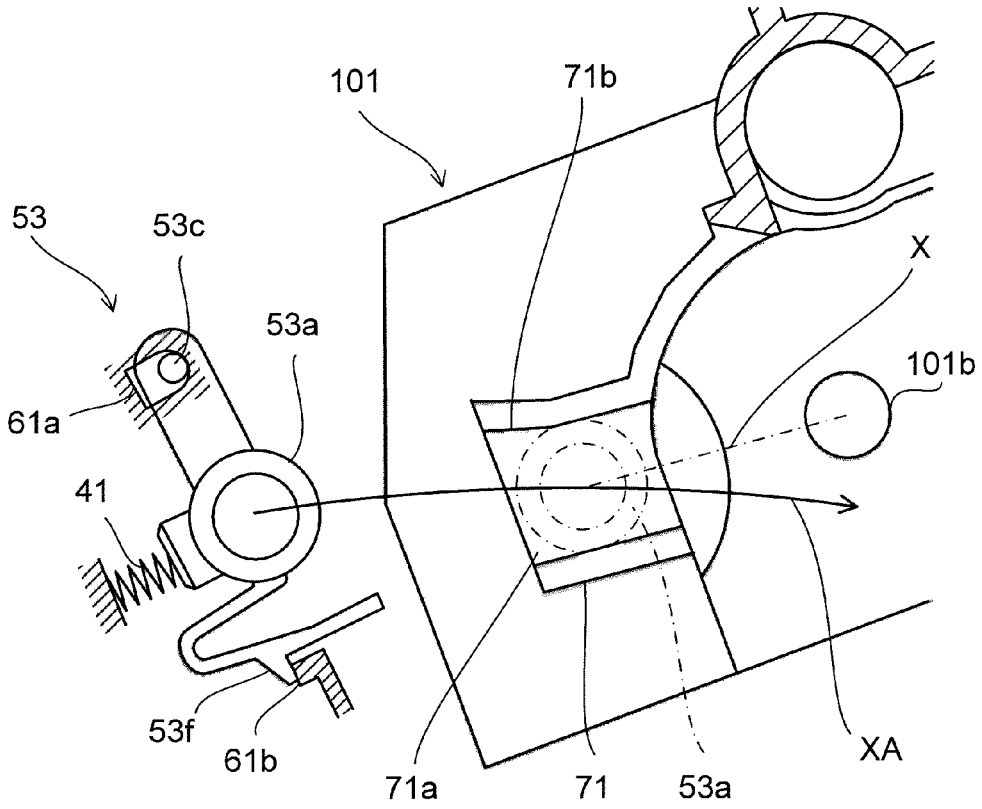
FIG. 7 is a diagram showing a state of the bearing member when the cover member is opened, according to the embodiment of the present disclosure.

FIG. 7 is a diagram schematically showing a state of the bearing member 53 and the bearing support portion 61 when the cover member 33 is in the open position. In FIG. 7, since the figure is seen from behind with respect to FIG. 5, the photosensitive drum 1 is disposed on the right side relative to the bearing member 53, and when the cover member 33 is closed, the bearing member 53 moves circularly in a direction indicated by an arrow XA. Furthermore, in FIG. 7, only main portions (the opening portion 61*a*, the contact portion 61*b*) of the bearing support portion 61 are schematically shown. Moreover, in FIG. 7, the outer peripheral portion 53*a* of the bearing member 53 in a state where the transfer roller 9 is in press-contact with the photosensitive drum 1 (the close position of the cover member 33) is indicated by alternate long and short dashed lines.

As described earlier, the guide groove 71*a* is formed in the bearing guide portion 71 in the apparatus main body 101. The guide groove 71*a* extends in the first direction X and is formed so as to have a width somewhat larger than the size of the outer peripheral portion 53*a* of the bearing member 53 so that the outer peripheral portion 53*a* of the bearing member 53 can be fitted therein. Furthermore, an upper entrance portion 71*b* of the guide groove 71*a* is widened upward, and the guide groove 71*a* therefore has a groove width larger on the entrance side than in a region in which the bearing member 53 is fitted. This facilitates the introduction of the outer peripheral portion 53*a* of the bearing member 53 into the guide groove 71*a*.

When the cover member 33 is in the open position as shown in FIG. 7, the regulation lug 53*f* of the bearing member 53 is in contact with the contact portion 61*b* of the bearing support portion 61 under a biasing force of the spring member 41. Furthermore, the convex portions 53*c* of the bearing member 53 are in contact with a right end surface of the opening portion 61*a* of the bearing support portion 61 under the biasing force of the spring member 41.

As the cover member 33 is closed with respect to the apparatus main body 101 from this state, the cover member 33 is moved circularly relative to the fulcrum 33*a* (see FIG. 3) as a center, which is provided at a lower portion in the apparatus main body 101. In consequence of this, the outer peripheral portion 53*a* of the bearing member 53 moves circularly as shown by the arrow XA. The direction XA in which the outer peripheral portion 53*a* of the bearing member 53 moves circularly does not coincide with the first direction X, and in a state where the outer peripheral portion 53*a* of the bearing member 53 is fitted in a predetermined position in the guide groove 71*a*, the first direction X and a direction tangential to the arrow XA deviate from each other by a predetermined angle.

Figure 8:
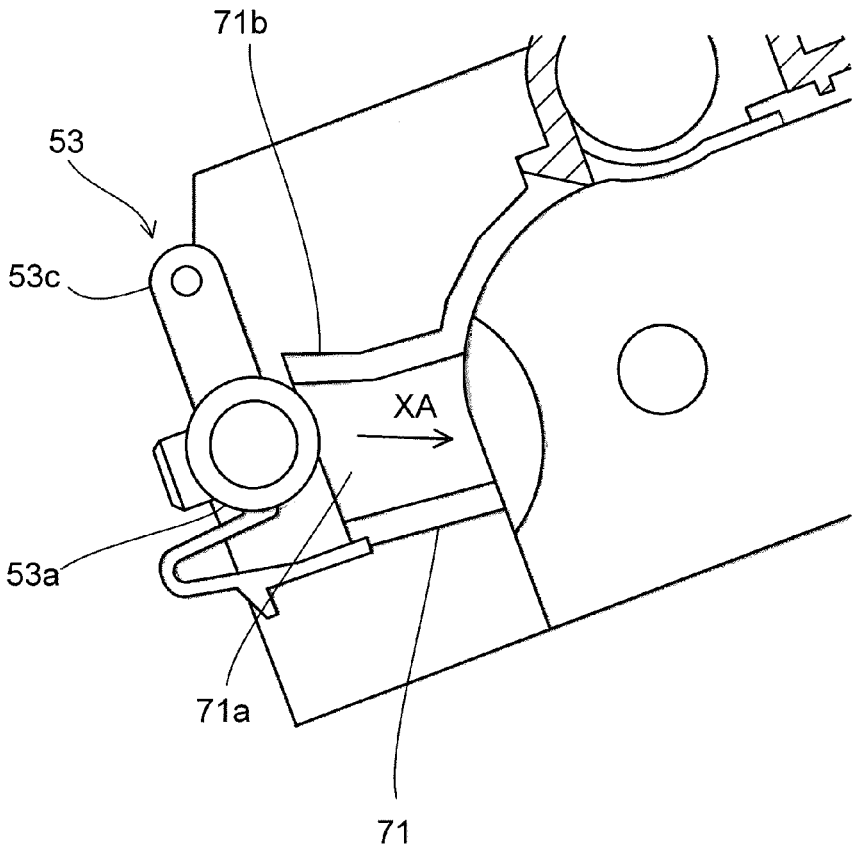
FIG. 8 is a diagram showing a state of the bearing member moving as the cover member is closed, according to the embodiment of the present disclosure.
Figure 9:
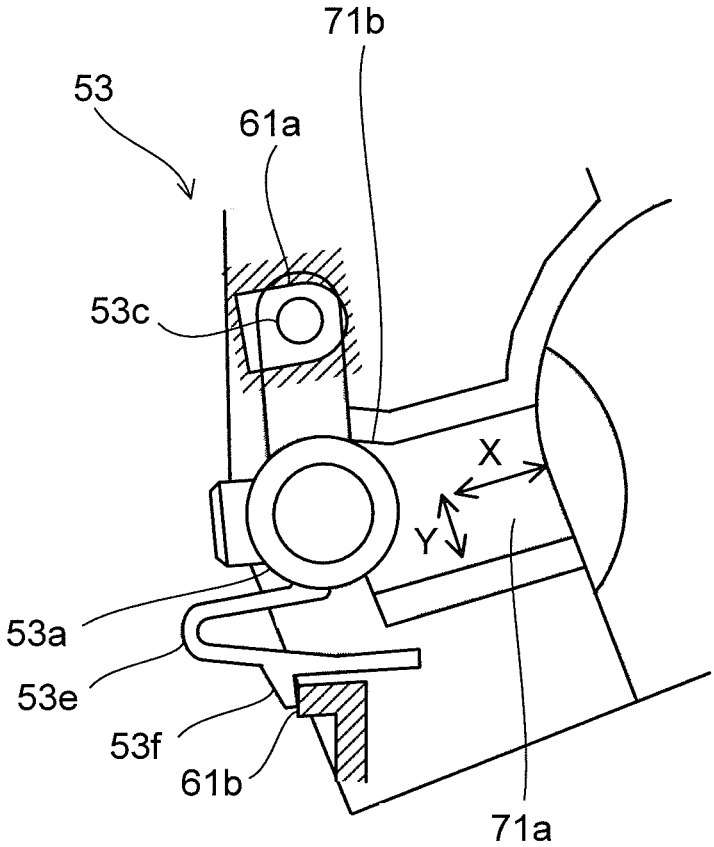
FIG. 9 is a diagram showing a state of the bearing member that has moved further from the state shown in FIG. 8, according to the embodiment of the present disclosure.
Figure 10:
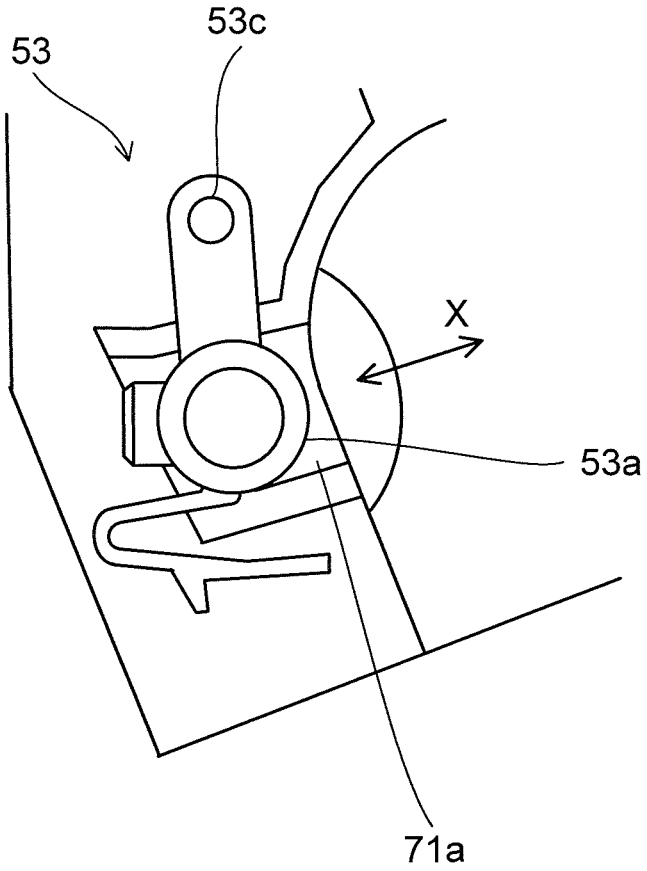
FIG. 10 is a diagram showing a state of the bearing member fitted in a bearing guide portion, according to the embodiment of the present disclosure.

FIGS. 8 to 10 are diagrams sequentially showing how the bearing member 53 is guided into the guide groove 71*a* as the cover member 33 is closed.

As shown in FIG. 8, when the cover member 33 is being closed, the direction XA in which the outer peripheral portion

53*a* of the bearing member 53 moves circularly does not coincide with the first direction X (see FIG. 7). With this in view, the upper entrance portion 71*b* of the guide groove 71*a* is formed so as to have a groove width in the up-and-down direction wider than the groove width of the guide groove 71*a* and, particularly, so as to be widened upward so that the entry of the outer peripheral portion 53*a* of the bearing member 53 into the guide groove 71*a* is facilitated. As the cover member 33 is closed, the outer peripheral portion 53*a* of the bearing member 53 first comes in contact with the upper entrance portion 71*b* of the guide groove 71*a*. When the bearing member 53 moves circularly further in the XA direction in consequence of a circular movement operation of the cover member 33, as shown in FIG. 9, the outer peripheral portion 53*a* of the bearing member 53 moves along the inclination of the upper entrance portion 71*b*. That is, in a state where the regulation lug 53*f* is in contact with the contact portion 61*b*, the outer peripheral portion 53*a* of the bearing member 53 moves to the side of the photosensitive drum 1 in the first direction X and also downward in the second direction Y. This movement of the outer peripheral portion 53*a* of the bearing member 53 in the first direction X and in the second direction Y results from the fact that the convex portion 53*c* of the bearing member 53 is movable within the opening portion 61*a* of the bearing support portion 61 in the first direction X and in the second direction Y. The hook portion 53*e* of the bearing member 53 is elastically deformable in the second direction Y, and in a case where the degree of this elastic deformation is set to be relatively large, the outer peripheral portion 53*a* of the bearing member 53 moves more smoothly in the second direction Y by the elastic deformation of the hook portion 53*e*.

As shown in FIG. 10, when the cover member 33 is being further closed, since the convex portion 53*c* of the bearing member 53 is movable within the opening portion 61*a* of the bearing support portion 61 in the first direction X and in the second direction Y, the outer peripheral portion 53*a* of the bearing member 53 moves along the guide groove 71*a* extending in the first direction X and is then fitted in a predetermined position in the guide groove 71*a*. Thus, as shown in FIG. 5, the transfer roller 9 comes in press-contact with the photosensitive drum 1.

Although the above-described embodiment describes a configuration in which the upper entrance portion 71*b* is formed in the guide groove 71*a*, when, in a state where the outer peripheral portion 53*a* of the bearing member 53 is fitted in the guide groove 71*a*, an angle between the first direction X and a direction tangential to the arrow XA is relatively small, the outer peripheral portion 53*a* of the bearing member 53 is introduced into the guide groove 71*a* without the need to form the upper entrance portion 71*b* in the guide groove 71*a*.

Furthermore, although the above-described embodiment uses the combination of the transfer roller 9 and the photosensitive drum 1 as the first rotary body and the second rotary body, respectively, the present disclosure is not limited thereto and may be applied to other types of roller pairs such as the resist roller pair 13 and so on.

The present disclosure is applicable to an image forming apparatus such as a copy machine, a printer, a facsimile, a multi-functional peripheral having functions of these apparatuses, or the like.

What is claimed is:

1. An image forming apparatus, comprising:

an apparatus main body;

a cover member which is movable in a circular direction between an first position and a second position relative to the apparatus main body;

a first rotary body that is rotatably supported on a side of the cover member;

a second rotary body that is rotatably supported on a side of the apparatus main body and, when the cover member is in the second position, comes in press-contact with the first rotary body so that a recording medium is conveyed between the second rotary body and the first rotary body;

a rotary shaft that is provided at each of both end portions of the first rotary body;

a bearing member that rotatably supports the rotary shaft;

a spring member that biases the bearing member to press the first rotary body against the second rotary body;

a bearing support portion that is provided in the cover member and supports, in addition to the spring member, the bearing member so that the bearing member is movable in a first direction connecting between rotation centers of the first and second rotary bodies and a second direction, wherein the second direction is perpendicular to the first direction and to an axial direction of the rotary shaft; and a bearing guide portion that is provided in the apparatus main body and has a guide groove that extends in the first direction and in which an outer peripheral portion of the bearing member is fitted when the cover member is in the second position, wherein the bearing support portion has an opening portion that extends in the first and second directions and a contact portion that is formed on an opposite side to the opening portion relative to the rotary shaft, the bearing member has a cylindrical bearing portion that rotatably supports the rotary shaft, a convex portion that is formed so as to protrude from an outer peripheral surface of the cylindrical bearing portion and is movable within the opening portion in the first and second directions, and a regulation lug that is formed at a position deviating from a position of the convex portion in a radial direction of the cylindrical bearing portion and, when the cover member is in the first position, can come in contact with the contact portion under a biasing force of the spring member, and the opening portion is wider than the convex portion in both the first and second directions in such a manner that the convex portion can move in the first and second directions within the opening portion, and when the cover member is closed with respect to the apparatus main body, the convex portion moves within the opening portion, and the outer peripheral portion of the bearing member is thereby guided into the guide groove and fitted therein, and the bearing support portion is formed integrally with the cover member.

2. The image forming apparatus according to claim 1, wherein the opening portion is a through hole, and the convex portion is provided at an end portion of each of a pair of arm portions extending from the outer peripheral surface of the cylindrical bearing portion so that the convex portions in a pair are opposed to each other and sandwich the opening portion from both sides.

3. The image forming apparatus according to claim 1, wherein the regulation lug is connected with the cylindrical bearing portion at a hook portion having elasticity in the second direction.

4. The image forming apparatus according to claim 1, wherein the guide groove is formed so as to be wider on an entrance side through which the outer peripheral portion of the bearing member is guided than in an area in which the outer peripheral portion of the bearing member is fitted.

5. The image forming apparatus according to claim 1, wherein the first rotary body is a transfer roller, and the second rotary body is a photosensitive drum.

6. The image forming apparatus according to claim 1, wherein when the cover member is in the second position, the regulation lug is away from the contact portion.

7. The image forming apparatus according to claim 1, wherein when the cover member is in the second position, the convex portion is out of contact with a periphery of the opening portion.

8. The image forming apparatus according to claim 1, wherein the opening portion is a through hole formed in a substantial trapezoidal shape in outline.

* * * * *